US007832396B2

(12) United States Patent
Abernethy

(10) Patent No.: US 7,832,396 B2
(45) Date of Patent: Nov. 16, 2010

(54) HIGH AIR FLOW POWERED AIR PURIFYING ANTI-CONTAMINATION DEVICE

(75) Inventor: Alfred Campbell Abernethy, Lexington, SC (US)

(73) Assignee: Radium Incorporated, Waynesboro, VA (US)

( * ) Notice: Subject to any disclaimer, the term of this patent is extended or adjusted under 35 U.S.C. 154(b) by 1011 days.

(21) Appl. No.: 11/423,440

(22) Filed: Jun. 10, 2006

(65) Prior Publication Data

US 2007/0095344 A1 May 3, 2007

Related U.S. Application Data

(60) Provisional application No. 60/689,164, filed on Jun. 10, 2005, provisional application No. 60/751,060, filed on Dec. 19, 2005.

(51) Int. Cl.
*A62B 17/00* (2006.01)

(52) U.S. Cl. ..... 128/201.29; 128/201.22; 128/201.23; 128/202.12; 128/202.19; 2/457

(58) Field of Classification Search ..... 128/201.22–201.29, 202.12, 202.13, 202.19; 2/2.11, 456, 457, 906
See application file for complete search history.

(56) References Cited

U.S. PATENT DOCUMENTS 3,293,659 A * 12/1966 Shepard ..... 128/201.15
3,963,021 A * 6/1976 Bancroft ..... 128/201.25
4,430,995 A * 2/1984 Hilton ..... 128/204.21
5,555,879 A 9/1996 Helin
5,581,816 A * 12/1996 Davis ..... 2/416
5,592,936 A 1/1997 Thomas
5,655,374 A * 8/1997 Santilli et al. ..... 62/3.5
5,896,579 A 4/1999 Johnson
6,035,450 A * 3/2000 Monsen et al. ..... 2/422
6,834,646 B2 12/2004 Alon
6,948,191 B2 9/2005 Avery
6,997,181 B2 * 2/2006 Fletcher ..... 128/202.15
2001/0052144 A1 * 12/2001 Paris et al. ..... 2/171.3
2003/0075174 A1 * 4/2003 Shahaf ..... 128/201.25
2003/0192537 A1 * 10/2003 Odell et al. ..... 128/201.22
2005/0060793 A1 * 3/2005 Rosie ..... 2/424
2005/0247310 A1 11/2005 Grove
2007/0192947 A1 * 8/2007 Plut et al. ..... 2/457

* cited by examiner

*Primary Examiner*—Steven O Douglas
*Assistant Examiner*—Valerie Skorupa
(74) *Attorney, Agent, or Firm*—Calhoun Thomas, III; Samuel Alexander Long, Jr.

(57) ABSTRACT

A high output, powered air purifying respirator that includes an anti-contamination suit, a filter for filtering particulates from the air, a high powered blower for delivering a cool flow of air to the body, and a stabilization mechanism. The stabilization mechanism is configurable in either head mounted or back mounted modules as desired by a worker. The head mounted configuration facilitates stream lined mobility and includes a head mounted suspension system with a circular rail and roller bearing halo around the worker's head for stabilizing the blower/filter and allowing for rotation of the worker's head inside the halo. The invention also includes additional modules, also configurable by the user, such as personal hydration and independent camera and dosimeter support.

24 Claims, 16 Drawing Sheets

HIGH AIR FLOW POWERED AIR PURIFYING ANTI-CONTAMINATION DEVICE

RELATED APPLICATIONS

This application is filed pursuant to two Provisional Patent Applications having Application No. 60/689,164 filed on Jun. 10, 2005 and Application No. 60/751,060 filed on Dec. 19, 2005.

FEDERALLY SPONSORED RESEARCH OR DEVELOPMENT

Not applicable.

REFERENCED OR INCORPORATED MATERIAL

Not applicable.

BACKGROUND OF INVENTION

The present invention relates to anti-contamination suits as used in industry where particulate contamination is of concern. Air particulates can include a number of components including: acids (such as nitrates and sulfates), organic chemicals, metals, and soil or dust particles. Of particular concern is radioactive particulates such as can be found in nuclear power facilities. Additionally, radioactive particulates would also be present in the event of a radioactive release such as through the detonation of a "dirty bomb." In these areas it is desirable to minimize radioactive particulate exposure and associated radiation doses with respect to workers working in contaminated zones. To this end, workers or other remediation crews often utilize anti-contamination suits for protection. Anti-contamination suits and their associated breathing mechanisms are also sometimes referred to as respirators.

One problem frequently encountered in the art of anti-contamination suits occurs with respect to the suit and equipment post operation, that is, after the completion of the task which required the anti-contamination suit. After completing such a task, the suit and equipment which have been exposed to the contaminated environment must either be decontaminated or otherwise properly and safely disposed. Such decontamination or disposal can be quite costly and it is therefore desirable to limit anti-contamination suit parts which must be discharged in such a way.

Anti-contamination suits can be divided into two general types with respect to worker mobility namely, tethered and independent. Tethered anti-contamination suits are so named because the worker is necessarily connected to a separate or stationary air source via some air conduit connected to a breathing air compressor supply system or a bank of air bottles. Such suits have advantages only in the limited circumstances where the worker is restricted to a small radius from the air source. In such a circumstance, the worker is free from wearing additional devices which decontaminate the air. However, if the worker desires mobility, he is further restricted by the hose length and must be mindful of the air conduit as it has the tendency to crimp or otherwise restrict necessary flow.

The second variety of suits is generally described as independent. These anti-contamination suits are not tethered to a stationary air source and independently provide the worker with filtered air. These suits are desirable for their high degree of mobility. However, they are also plagued with a number of disadvantages. Independent anti-contamination suits do not require a breathing air source. Therefore, the user must wear air filtering equipment to minimize the intake of air borne particulates from the ambient air. As a result, bulky air blowers and battery packs of limited time duration add weight and awkward attachments to the suit. In many designs, blowers and filters are positioned around the waist of the worker and have conduit to deliver the air to the worker's head. Such suits suffer from low air flow to the face which results in a build up of excessive metabolic heat in the suit and fogging of the suit visor or hood. Excessive heat in the suit can lead to debilitating heat stress for the worker. Moreover, the addition of air conduit creates air flow resistance to push the air through the hose and, once again, adds the implication of potential crimping of any hose thereby restricting air flow.

Another problem prevalent to the independent air suit is the bulkiness of the added equipment. With respirators and blowers attached to the waist of the worker, the worker often has a difficult time accessing and maneuvering in tight settings. Often the work environment is very hot and the industry currently deals with the heat by having workers wear an optional "ice vest" which consists of a vest with big, heavy bags or compartments containing the common "blue gel" found in freezer packs. As this material goes from frozen to liquid form it often shifts downward in its location on the vest and can be perceived by the wearer as dead weight.

In nuclear industry facilities and other radioactive environments (such as would follow a nuclear mishap or "dirty bomb" detonation), the problems identified above with respect to tethered and independent anti-contamination suits are compounded by the intensity of the environment. In a radioactive environment, time is of the essence. Every second that a nuclear power operation is down while a worker is in the field addressing the problem costs vast sums of money. And, more importantly, every second that the worker is in a radioactive environment increases his exposure to radioactivity which increases the dose of radiation he receives. Therefore, it is of a great advantage when the worker is free and unencumbered so that he may perform his task and leave the radioactive environment in as little time as possible.

Unfortunately, under the current state of the art, anti-contamination suits having the above outlined drawbacks contribute greatly to the time spent in radioactive environments in order to complete a task. Awkward filter/blower placement on anti-contamination suits produce inefficient designs that fail to deliver good air flow to the user and limit mobility. These designs increase user discomfort and the time necessary to perform most tasks. Tethers or similar conduit in other suits are dependant on the hose length which limits mobility and requires the worker to spend time monitoring the line for crimps thus increasing the amount of time in the contaminated environment. Importantly, low volumes of air flow to the face and lack of air flow to the entire body contribute mightily to an overheating of the worker and a resultant inefficiency in work conditions. Furthermore, the short battery life of battery packs in the independent suits require the worker to spend even more time monitoring battery life and frequently changing or charging batteries. Taken together, these drawbacks found in the current state of the art lead to performance discomforts and difficulties while adding considerable time to accomplish a given task. Therefore, there is clearly a need in the art for a device which continues to shield the worker from harmful contamination yet also provides conditions which approach those that would exist if the worker wore no suit while completing a task at peek efficiency.

SUMMARY OF THE INVENTION

Given the problems present in the current state of the art, it is the central object of the present invention to provide an anti-contamination device that improves the in suit environment and by doing so also improves the performance of the workers who wear the suit in the field so as to allow them to complete their tasks in less time while maintaining protection from particulates. It is a further object of this invention that the anti-contamination suit be versatile and economically efficient in its manufacture and in its field deployment.

In furtherance of these objectives, the present invention contemplates an anti-contamination device that is designed to shield the worker from contaminates and at the same time allow the worker to perform his tasks more efficiently and with greater comfort. The present invention combines cooling from enhanced air flow, including full body cooling, comfort, visual clarity, and even personal hydration in a suit that is streamlined for work in tight places and independent of any tethers to an outside air source. Additionally, the suit is relatively inexpensive to manufacture and operates efficiently by directly delivering air to the user in a very efficient means and by minimizing parts that need to be disposed of safely or otherwise decontaminated.

One feature of the present invention is that it is designed to be modular in function. This is to say that versatility is emphasized by the flexibility in blower/filter placement. The invention contemplates the blower/filter being installed at the top of the suit (on the worker's head) or at the rear of the suit (on the upper portion of the worker's back) while utilizing the same power belt in either configuration. Further, the invention is designed to work with a wide variety of suit materials and designs. Specifically, the suit can be a one piece, full bodied jumpsuit design, a one piece "hood only" design, or a two piece hood and pants option. The suit can also be constructed of a number of materials including, but not limited to PVC, paper, or polyethylene.

The present invention has as a central feature a high output blower that delivers filtered air directly to the head and face of the worker without need for any conduit or tubing which might crimp or otherwise restrict air flow while in use. The high output blower is powerful enough to deliver positive pressure air throughout a one piece "jumpsuit" type suit design. In either the head placement or the back placement of the blower/filter, the high air flow is designed to travel across the face of the worker drawing away metabolic heat, cooling the worker, and preventing fogging to the suit visor or hood. The air then passes over the rest of the body, providing further cooling, and then out of the suit via strategically placed vents or one way valves in the suit.

As worker comfort is an important component in operational efficiency, another central feature of the design relates to worker comfort as apart from the cooling aspects identified above. Specifically, the blower/filter device is designed to be comfortable to wear in either the head or the back configuration. It is lightweight and in the back configuration attaches to the worker via a comfortable double shoulder harness. Lightweight system design is achieved by remotely locating the power source to a very thin battery power belt. In the head configuration, the device lightly sits atop the worker's head. Importantly, the head adorned configuration does not limit the worker's neck or head movement because the invention's roller bearing or swivel mechanism allows head movement without translating any displacement to the blower/filter or to the suit's hood. The device also contemplates a suspension system that acts as a shock absorber. The suspension system prevents or limits movement in the head mounted blower/filter from translating to the worker's head causing discomfort.

Another important feature of the invention relates to the flexibility in adding additional components. The device has attachment points for such devices as dosimeters 410 and personal cameras 400. If these devices also require an independent power source, the suit's battery power belt comes equipped with several extra power connections. Moreover, the battery power belt is designed to achieve a long life from the attached batteries allowing the worker more time in completing his task. Furthermore, the batteries selected for use in the battery power belt are capable of quick recharge.

The principle point of attachment for the additional components is the spider ring. The spider ring serves a number of important functions for the suit in addition to being a platform for attachments. When the blower/filter is configured on the head, the spider ring serves to ensure that the bubble hood of the anti-contamination suit does not collapse and directs the air flow to the front of the hood. When the blower/filter is configured on the upper back, the spider ring serves as protection for the blower opening and additionally as an air foil to direct the flow of the air into the hood and over the head of the worker thereby facilitating cooling and ventilation.

Additionally, the invention contemplates an optional personal hydration pack. The hydration pack serves the multiple purposes of cooling, hydration, and a stabilizer mount for the blower/filter further aiding in the worker's comfort and resultant efficiency. Water can be frozen inside a hydration pack which is attached inside the anti-contamination suit. The ice aids in cooling the worker. Once the ice melts, the worker then can use the water to rehydrate himself via a tube carrying the water to his mouth.

Another important element of the invention relates to contamination and associated decontamination and disposal. A central feature of the device is that the high powered blower is located interior to the anti-contamination suit. Such a location means that the blower does not have to undergo time-consuming and expensive decontamination following operation and is therefore ready to be reused. Further, the battery pack belt is designed to be worn either inside the anti-contamination suit, thereby not requiring decontamination, or it can be worn exterior to the suit but inside a protective sleeve, similarly not requiring decontamination. Importantly, the invention also contemplates anti-contamination protection for other devices typically encountered in the field. For instance, head mounted safety devices such as hard hats and ear protection can be worn by the worker interior to the suit with the back mounted configuration such that air flow to the worker is not inhibited and the additional devices do not require decontamination.

BRIEF DESCRIPTION OF THE SEVERAL VIEWS OF THE DRAWINGS

In order to understand the invention and to see how it may be carried out in practice, a preferred embodiment will now be described by way of non-limiting example only, with reference to the accompanying drawing in which.

DETAILED DESCRIPTION

Figure 1:
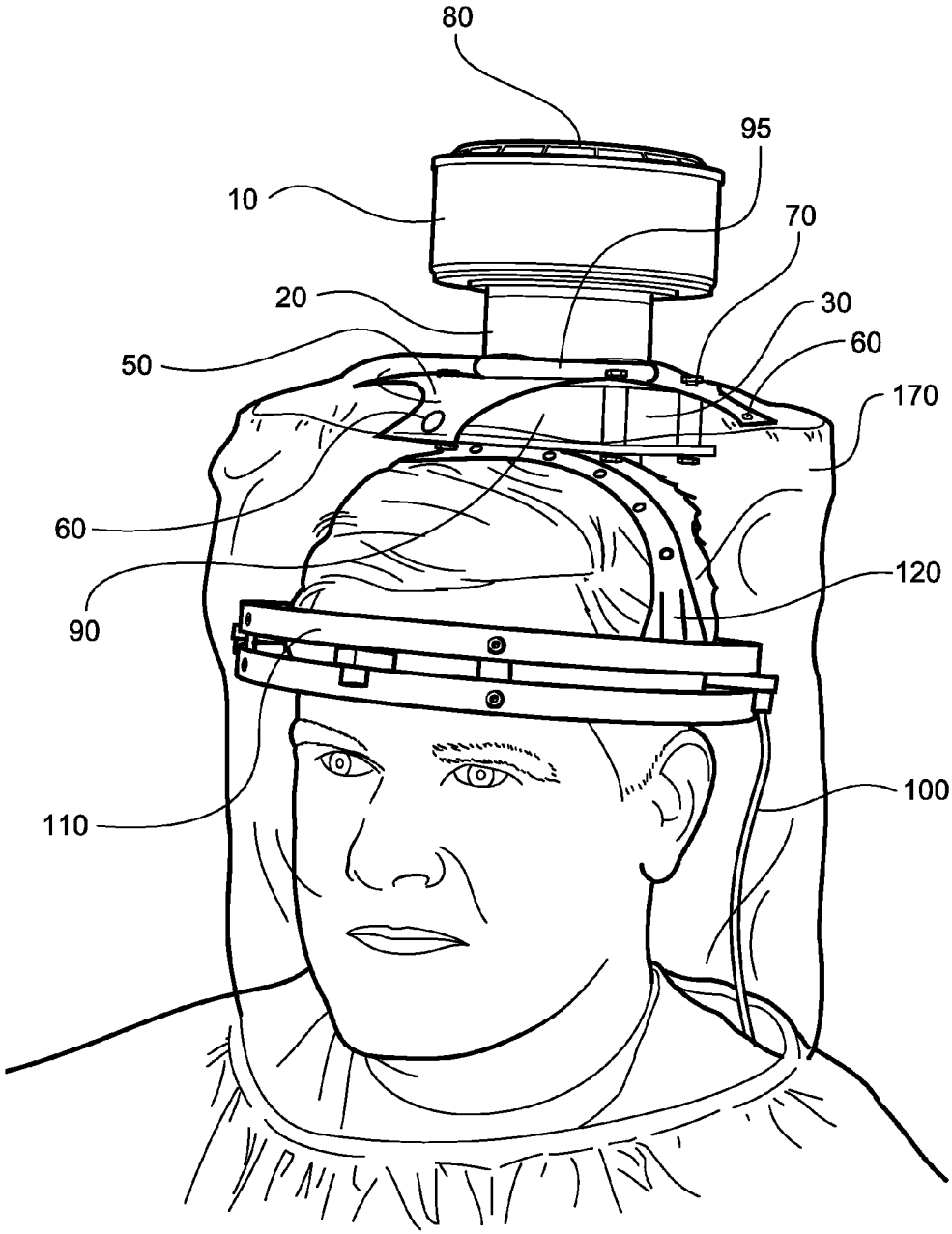
FIG. 1 is a perspective view of a worker's head wearing the blower/filter with the head-mounted stabilizer as see through the clear hood.
Figures 2A, 2B, 2C:
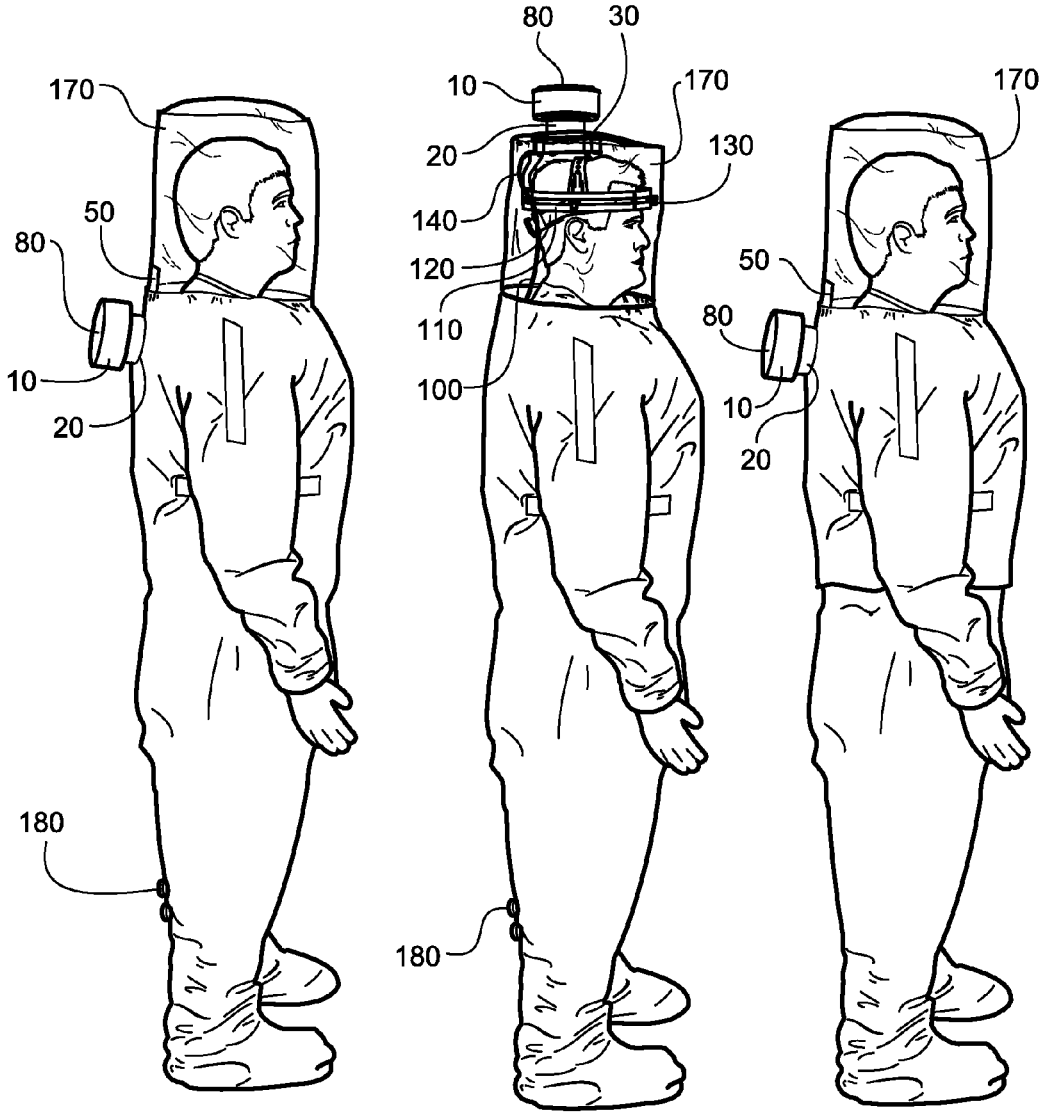
FIGS. 2A-2C are side views of the one piece suit with the blower/filter unit in the back mounted configuration, the one piece suit with the blower/filter in the head mounted configuration, and the two piece suit with the blower/filter unit in the back mounted configuration.
Figures 3A, 3B, 3C:
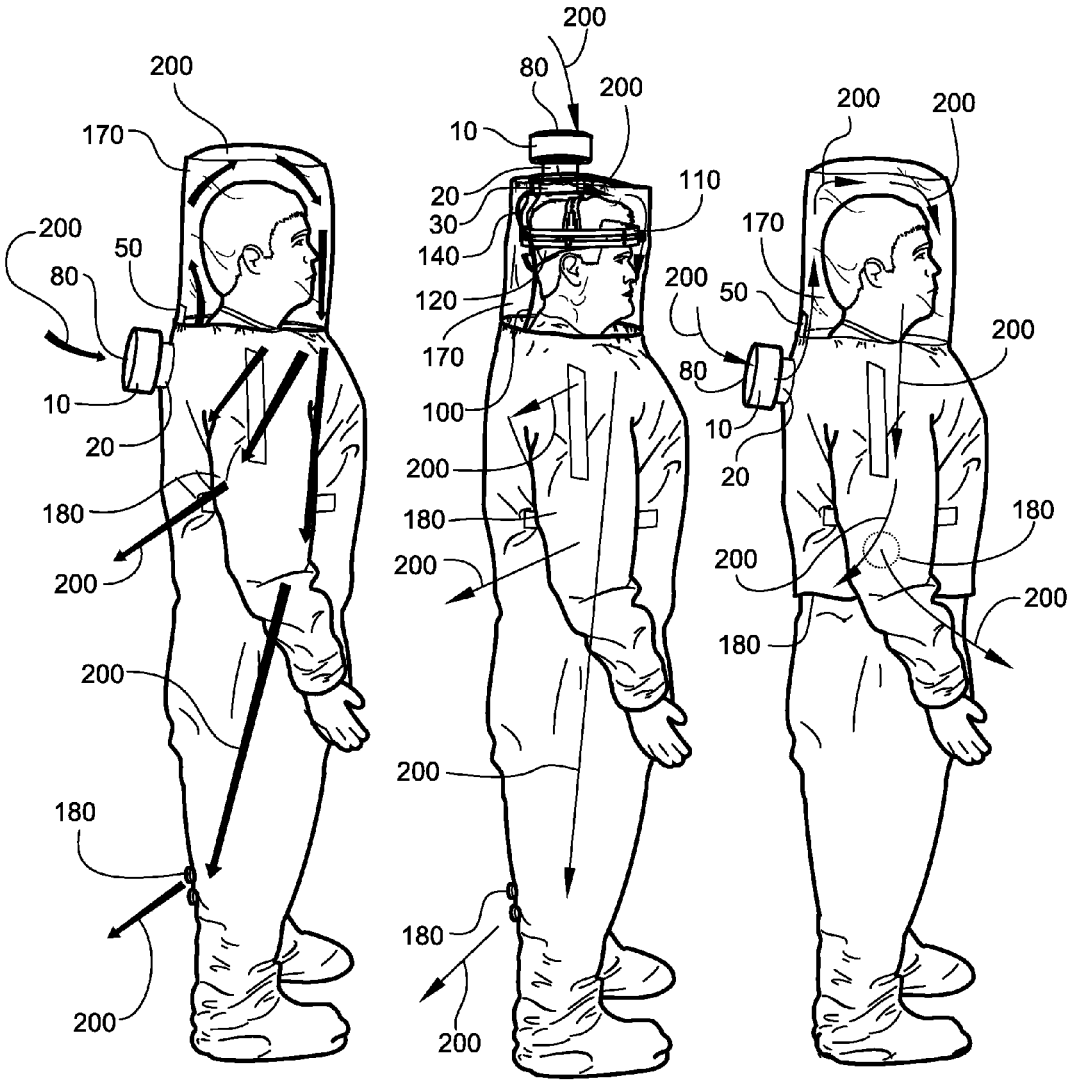
FIGS. 3A-3C are similar side views depicting air flow through the suits in their various configurations.
Figure 4:
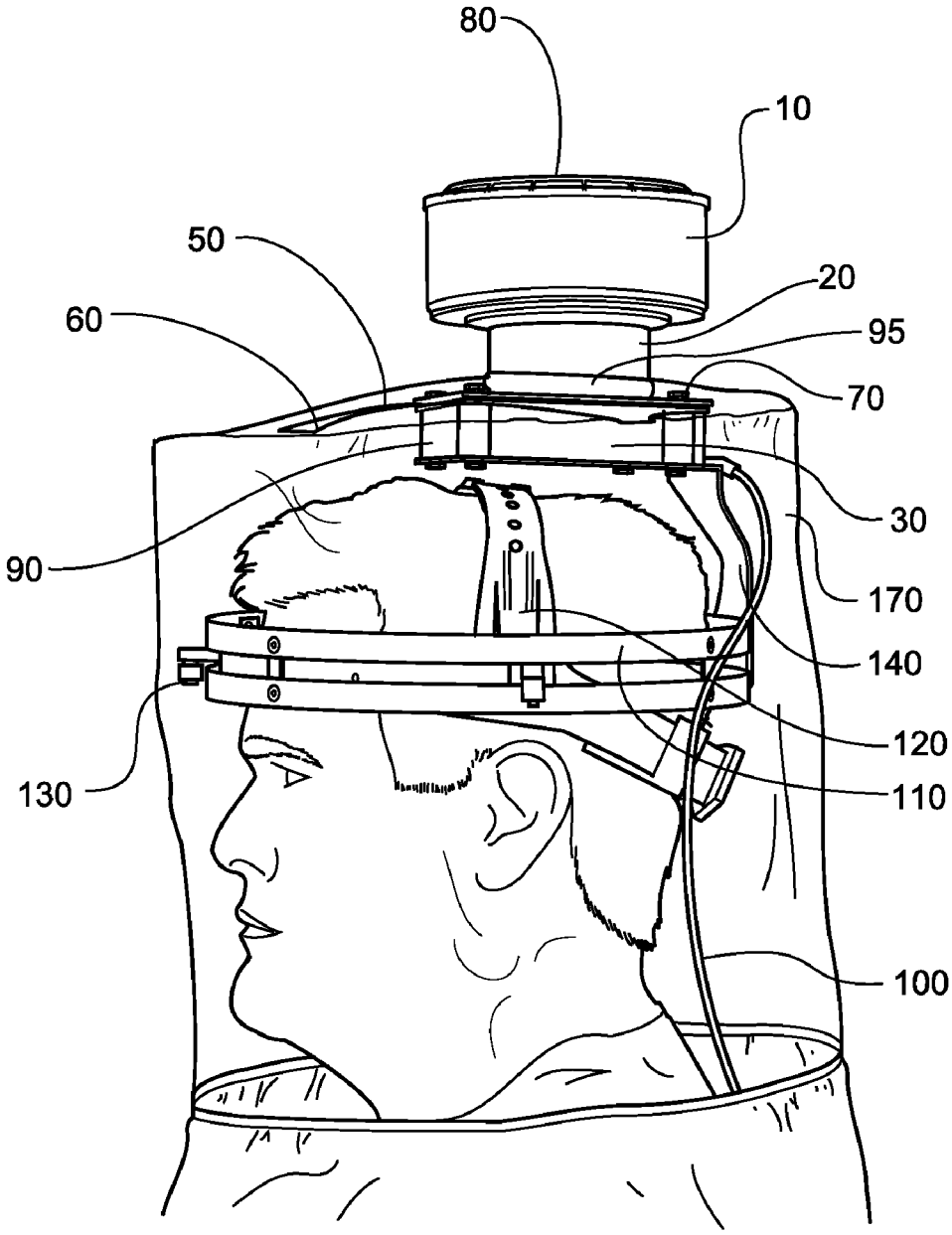
FIG. 4 is a side view of a worker's head wearing the blower/filter with the head-mounted stabilizer as see through the clear hood.
Figure 5:
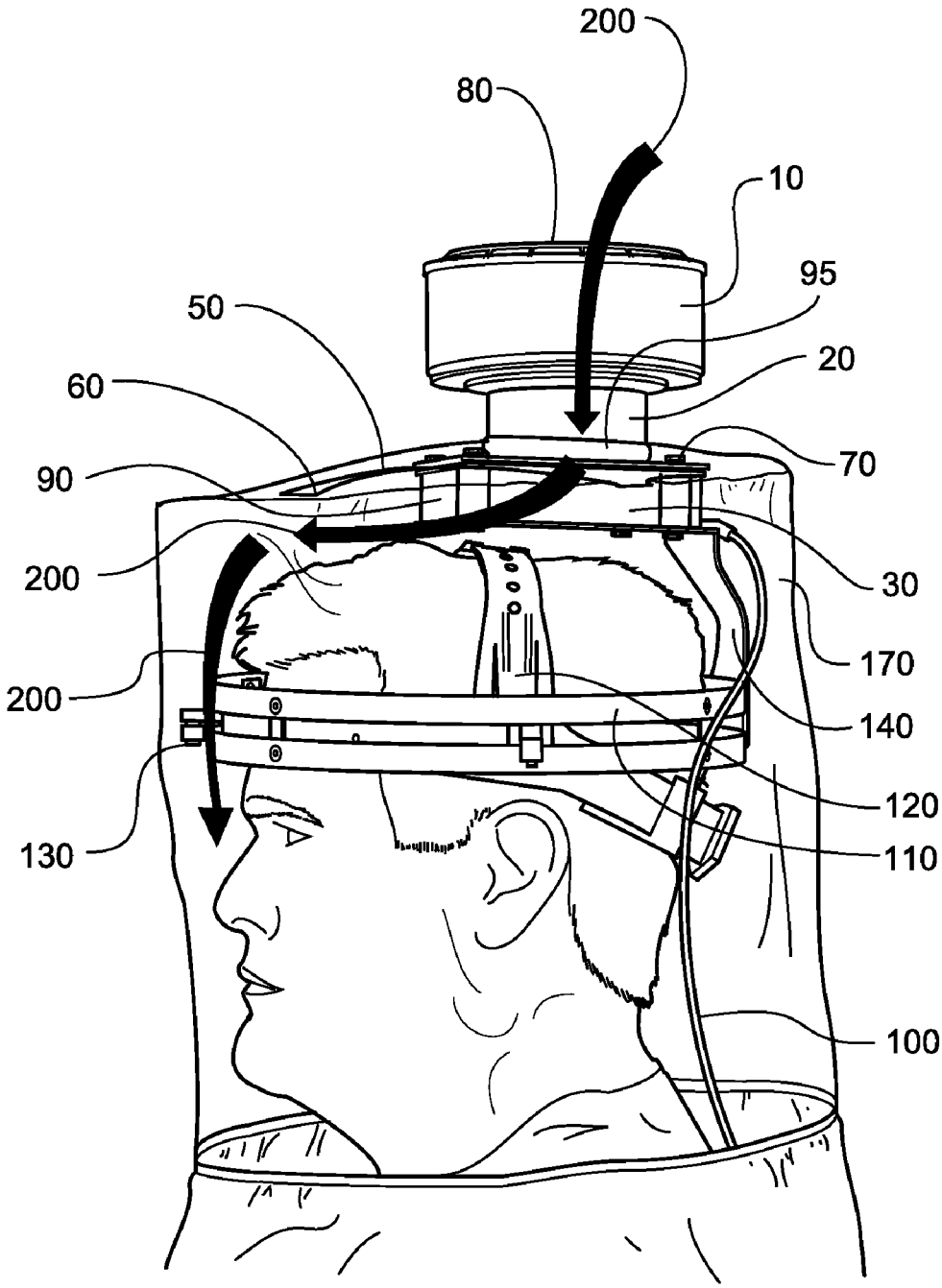
FIG. 5 is the same view as FIG. 4 with the depiction of how air is drawn in the filter at the top, blown forward from the blower and guided down the worker's face by the clear hood.
Figure 6:
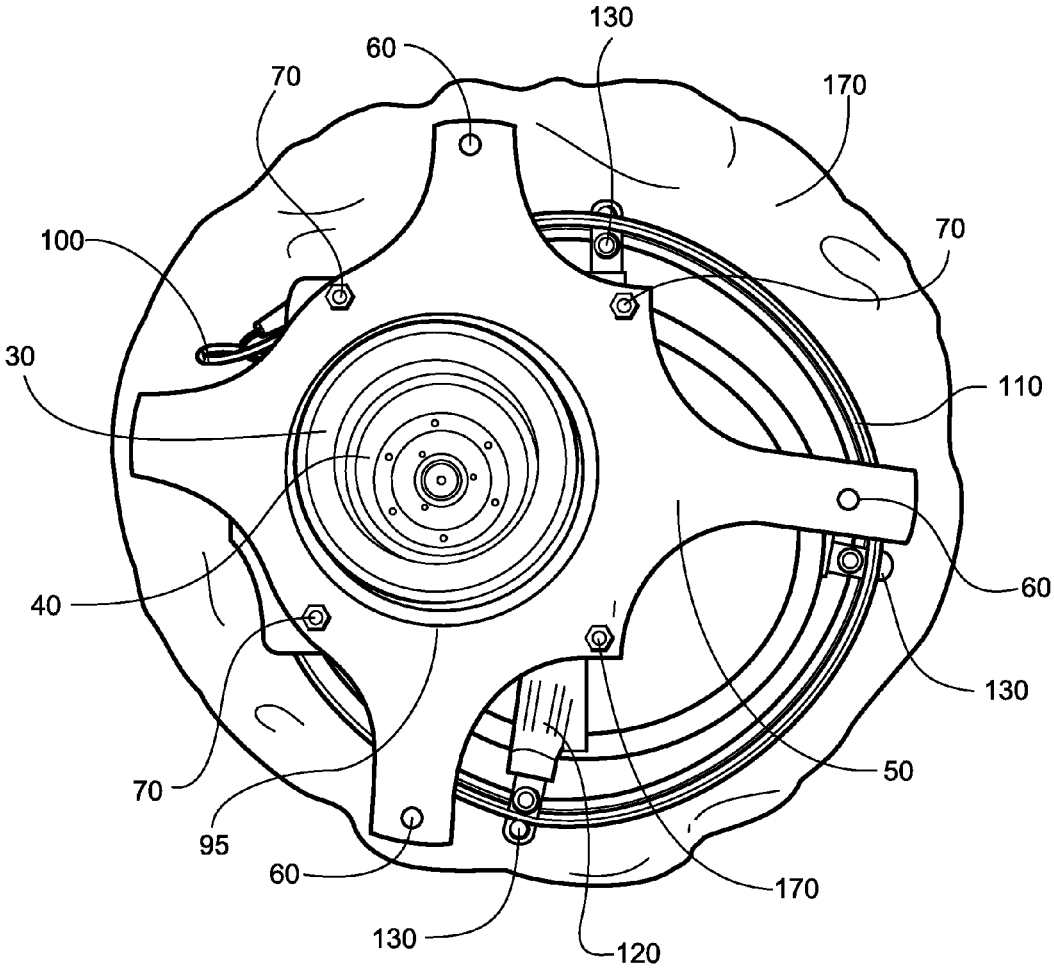
FIG. 6 is a slightly angled view from above where the filter has been removed and what is shown is the blower's threaded connection tube coming up through the spider ring that is covering and obscuring nearly all of the blower and some of the halo band, adjustable head band and the roller/swivel mechanism that connects the two bands.
Figure 7:
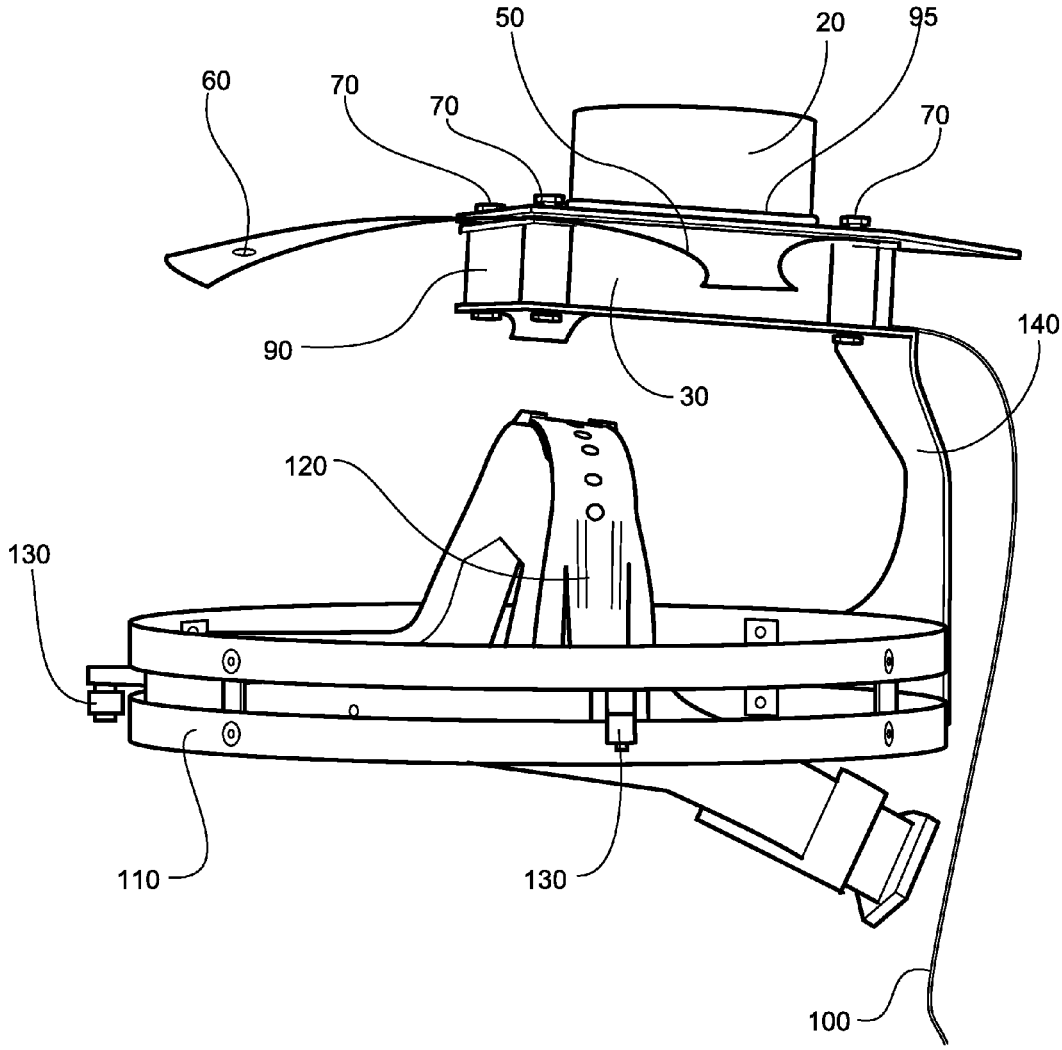
FIG. 7 is a slightly angled side view of the same device depicted in FIG. 6, again without the filter being shown in this drawing.
Figure 8:
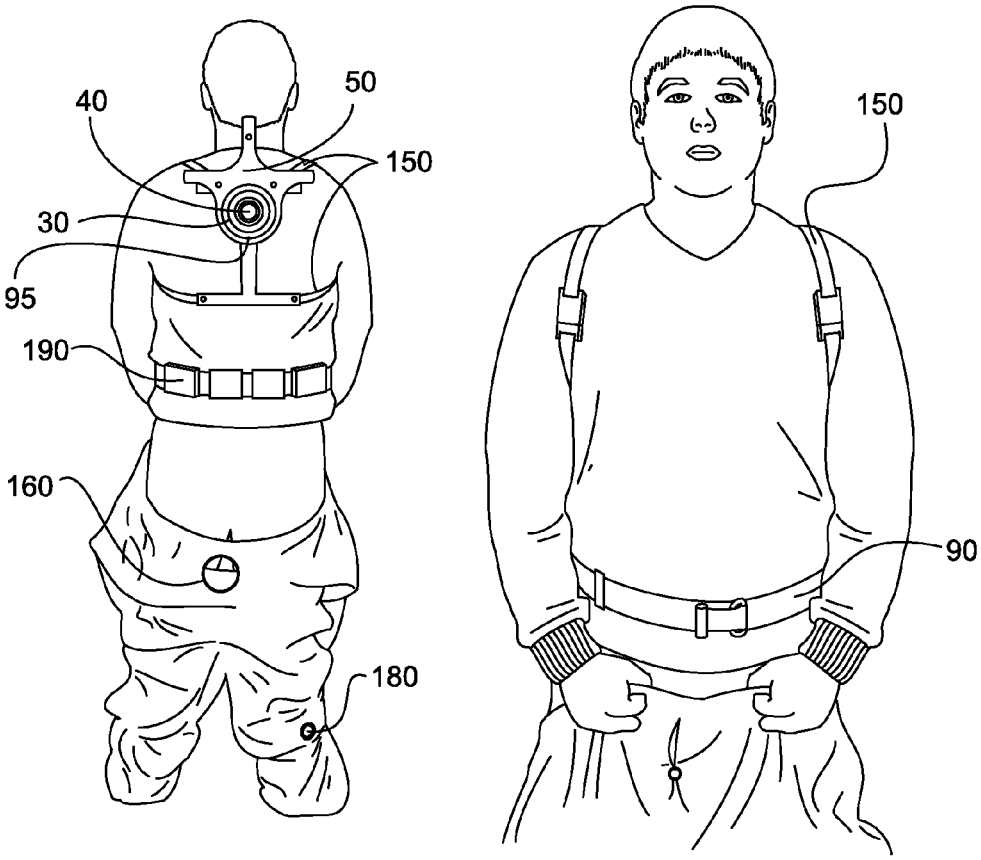
FIG. 8 is a front and back view of a worker wearing the back stabilizer with the blower and spider ring shown without the filter, in the back mounted configuration, and with the battery pack belt, the anti-contamination suit being lowered to reveal the above items.
Figure 9:
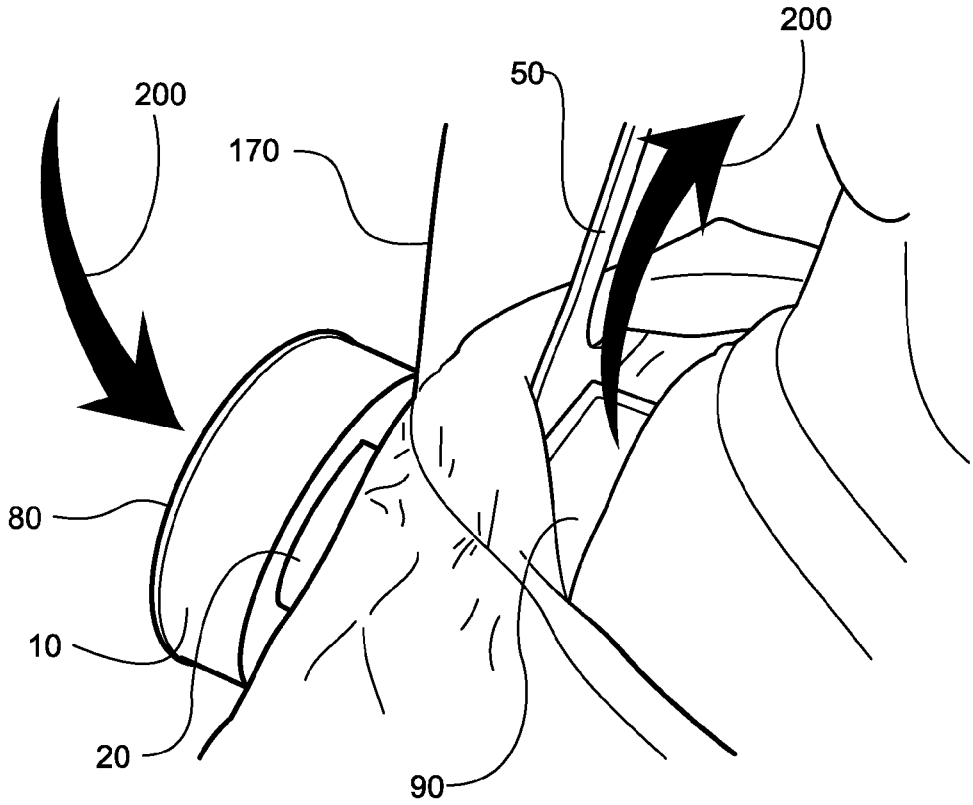
FIG. 9 is a close in perspective view of the filter and protective collar in the back mounted configuration with the front arm of the spider ring holding the suit back from covering the opening of the blower and showing air being drawn into the filter and blown up behind and ultimately over the head and face of the worker inside the clear hood.
Figure 10:
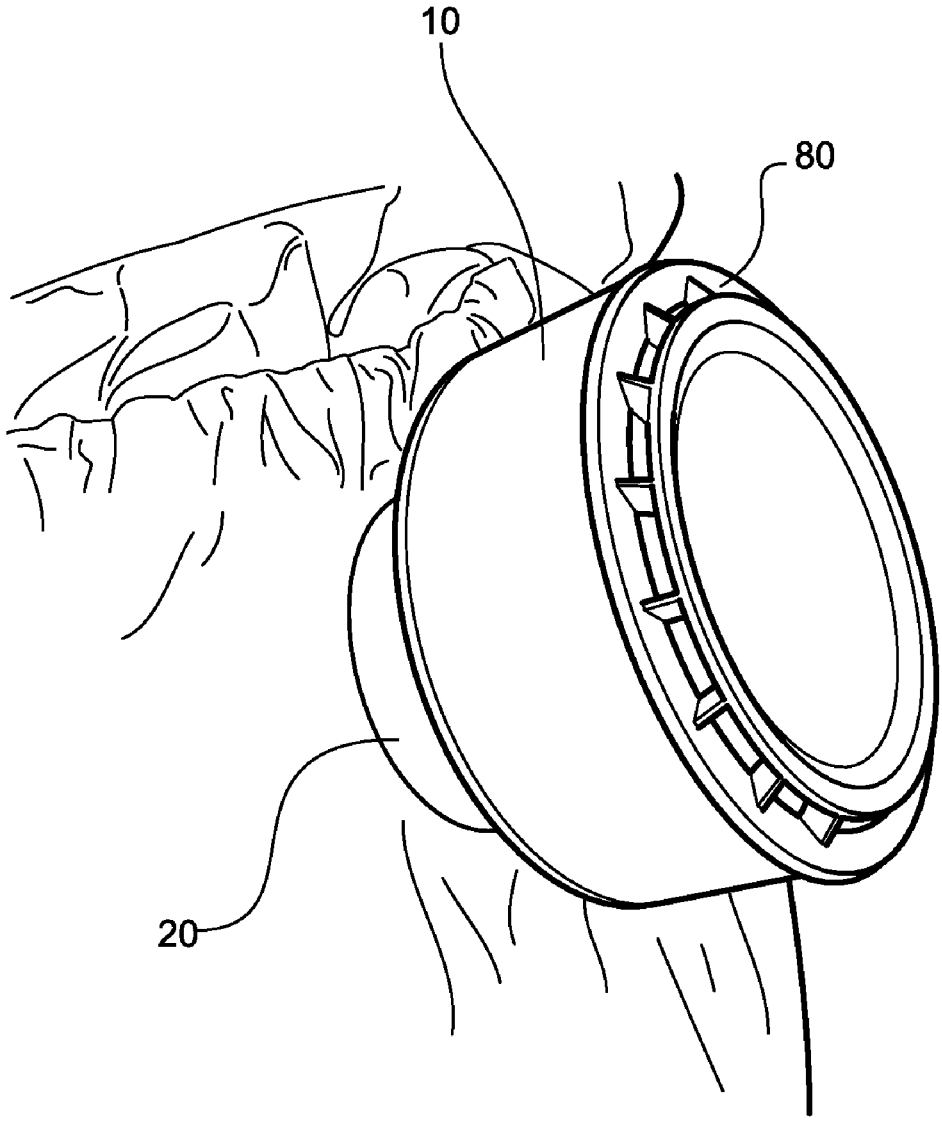
FIG. 10 is a different perspective view of a back mounted configuration of the filter, its intake ducts and the protective collar that surrounds the tubes that connect the blower to the filter, said collar going from the filter to the edge of the hole in the suit where it seals against the suit pressing into the sealing gasket positioned inside and just under the edge of the hole in the suit.
Figure 11:
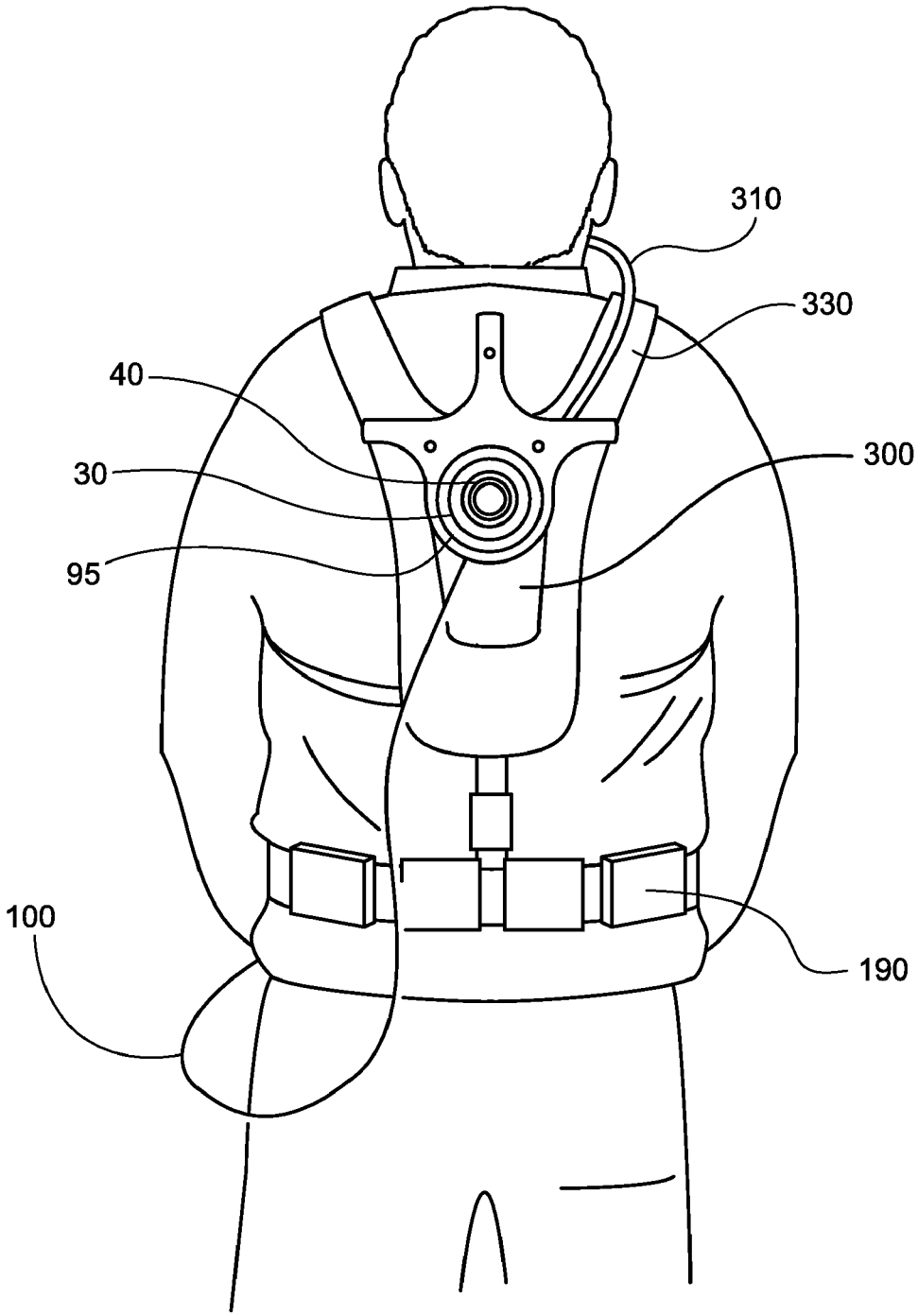
FIG. 11 is a rear view of a worker wearing the hydration back pack and using it as the stabilizing mechanism for the blower unit, shown again without filter and with the spider ring, the blower intake tube, and the sealing gasket, said worker also wearing the battery belt pack but not the anti-contamination suit.
Figure 12:
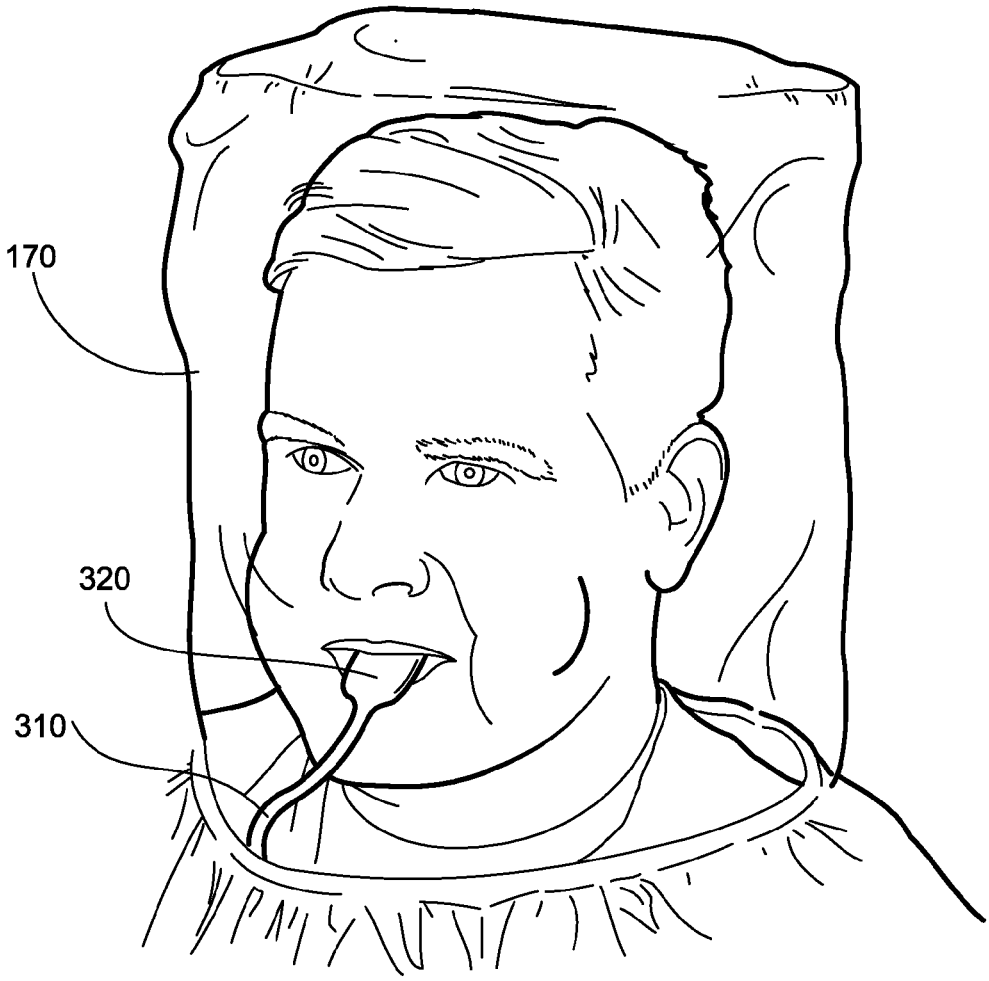
FIG. 12 is a perspective view through the clear hood of the worker using the hydration pack tube and associated bite mouth piece to obtain water or other hydrating liquid stored in the hydration back pack.
Figure 13:
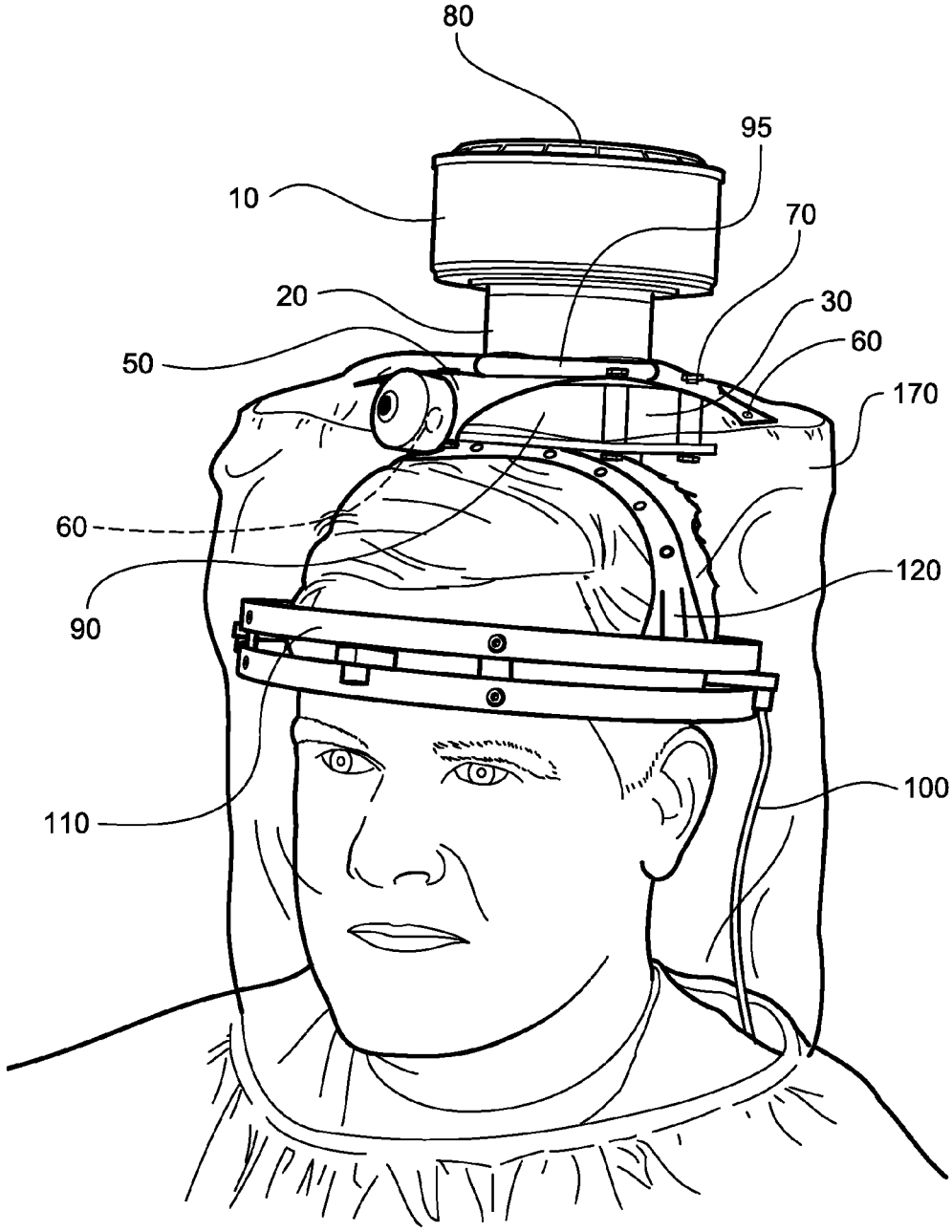
FIG. 13 is a perspective view of a worker's head wearing the blower/filter with the head-mounted stabilizer and camera as seen through the clear hood.
Figure 14:
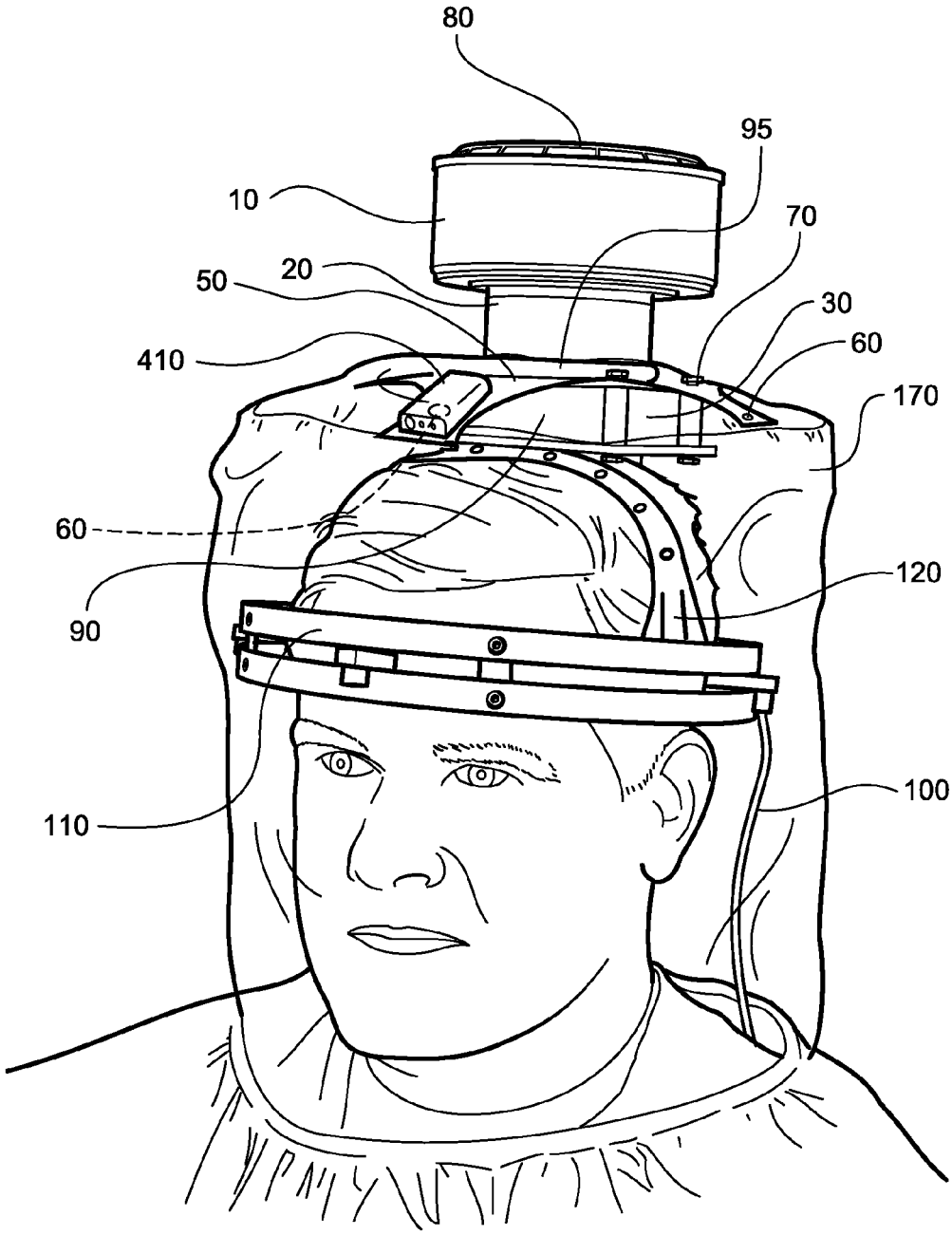
FIG. 14 is a perspective view of a worker's head wearing the blower/filter with the head-mounted stabilizer and dosimeter as seen through the clear hood.
Figure 15:
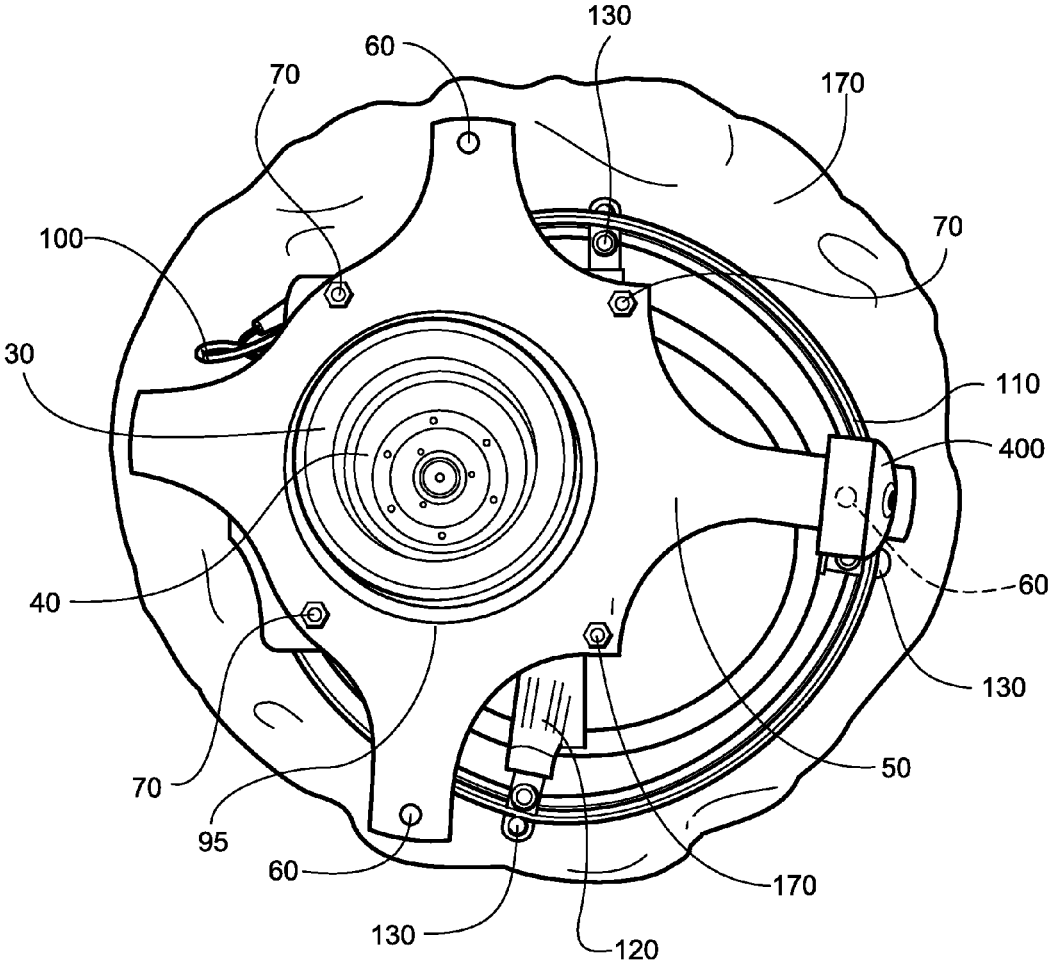
FIG. 15 is a slightly angled view from above, featuring a camera, and where the filter has been removed and what is shown is the blower's threaded connection tube coming up through the spider ring that is covering and obscuring nearly all of the blower and some of the halo band, adjustable head band and the roller/swivel mechanism that connects the two bands.
Figure 16:
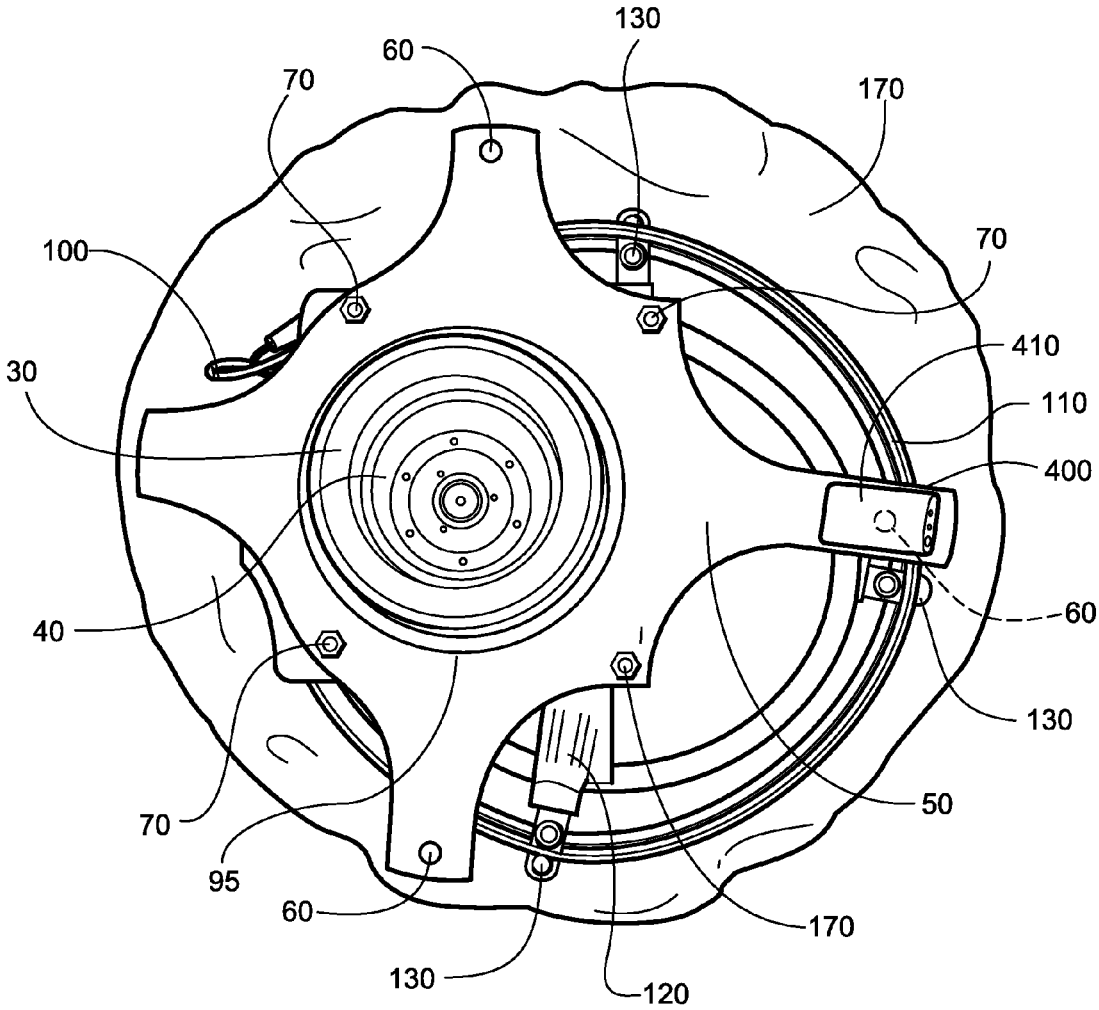
FIG. 16 is a slightly angled view from above, feathuring the dosimeter, and where the filter has been removed and what is shown is the blower's threaded connection tube coming up through the spider ring that is covering and obscuring nearly all of the blower and some of the halo band, adjustable head band and the roller/swivel mechanism that connects the two bands.

It is to be understood by a person having ordinary skill in the art that the present discussion is a description of exemplary embodiments only, and is not intended as limiting the broader aspects of the present invention. The following example is provided to further illustrate the invention and is not to be construed to unduly limit the scope of the invention.

The anti-contamination suit garment of the present invention can be any variety of protection systems that surrounds the worker and protects him from a contaminated environment. Also included in the invention is any partially protective suit such as a solo hood protective garment. The suit can likewise be made of many materials as discussed supra. In the preferred embodiment, the suit utilizes a clear "bubble hood" made of clear PVC. Likewise, the remainder of the suit, whether one or two pieces, is also made of PVC though the invention is not limited to any one material.

Inside the suit is the blower unit 30 which provides air 200 and cooling to the worker. The blower is a high output "squirrel cage" type blower and is located inside the suit. The blower is attached via removable screw/nut connection 70 to the stabilizing mechanism.

In the back mounted module, the stabilizing mechanism is a back pack 150 with a double shoulder harness. The back pack 150 is a broad "I" shape with matching adjustable straps that secure the unit to the worker and a lower back strap that can secure the back pack to the battery belt power pack 190. When the hydration bladder 300 and its associated hydration back pack 330 are used, the flap of the hydration back pack substitutes for and provides the same stabilizing mechanism as the broad "I" back pack 150. Prior to operation in the back mount module, the screw/nut connections 70 will be tightened securing the blower unit to the broad "I" back pack 150 or the hydration back pack 330.

In the head mounted module, the stabilizing mechanism is a head mounted suspension system that attaches to the blower 30. The purpose of this suspension system is to both protect the head from impacts to the filter 10 and to allow the head to rotate freely inside the hood 170 without disturbing the hood or blower unit 30. Using the same removable screw/nut connection method 70, the blower 30 is attached to a shock absorbing member 140. This member is then fixedly attached to the halo ring 110. The halo ring 110 encircles the head of the worker and acts as a rail on which a roller bearing or swivel mechanism 130 slides. The swivel mechanism 130 is fixedly attached to an adjustable head band 120 and is slidingly attached to the halo ring 110. The adjustable head band 120 is designed to fit the worker's head comfortably with pads and it both encircles the head and crosses over the top of the head. With this configuration, rotation of the head about the axis of the neck in the plane of the halo band 110 is thus possible without any disruption to the hood 170 or blower unit 30.

Also connected to the blower unit 30 via screw/nut means 70 is the spider ring 50. In the back mounted and the head mounted modules, the spider ring 50 is attached to the blower 30 on the side opposite the stabilizing mechanism. In the case of the back mounted module this is either the broad "I" back pack 150 or the hydropack back pack 330 and in the case of the head mounted module this is the shock absorbing member 140. The spider ring 50 is designed to protect the blower opening 90 and facilitate air flow 200 from the blower 30 in the back mounted module up and into the hood 170. In the head mounted module, the spider ring 50 is designed to facilitate air flow 200 by preserving the shape of the hood 170 and also serve as an attachment platform for mounting a small video camera 400 and other small devices such as dosimeters 410 and lights using the spider ring point of attachment holes 60.

The stabilizing mechanism, the blower 30, and the spider ring 50 are all internal to the suit to minimize or eliminate any need for decontamination. Extending through a specially placed hole in the suit (either in the hood or on the back 160) is a cylindrically threaded intake extension 40 that is part of the blower unit 30. In this embodiment, the threads are inward. These threads mesh with the outwardly disposed threads of the filter 10. In order to seal the suit and to protect the cylindrically threaded intake extension 40 of the blower 30 from contamination, a protective collar 20 that is slightly larger in diameter than the blower intake extension 40 is installed between the blower 30 and the filter 10 by slipping it over and around that outer diameter of the blower intake extension 40. The protective collar 20 presses on the suit and forms a seal as the threads of the filter 10 and blower intake extension 40 mesh and the filter 10 is screwed on. That is, as the filter 10 and blower intake extension 40 threads are screwed together, the top edge of the protective collar 20 presses against the filter 10 and the bottom edge of the protective collar 20 presses the rim of the suit hole against a sealing gasket 95 positioned inside the suit and around the blower intake extension 40 thereby forming a tight seal. The sealing gasket 95 rests against the spider ring 50 which the blower intake extension 40 first passes through.

Power is supplied to the blower 30 via a cable 100 with a locking electrical connector that connects to the battery pack belt 190. The battery pack belt 190 is configured in a very thin belt designed to be worn by the worker. The battery pack 190 has connections for the blower 30 as well as other devices such as a small camera 400. In the preferred embodiment, the batteries are long life, quick recharging batteries such as Nickel-Metal Hydride. In addition the battery pack belt 190 can be worn inside the suit or outside. When worn outside the suit, the battery pack belt 190 is sleeved in a protective sleeving so that it remains contaminate free.

When desired by the worker, the hydration bladder 300 and hydration back pack 330 that securely carries it are worn on the back of the worker inside the anti-contamination suit. When the back mounted configuration is desired, the hydration back pack 330 also functions as the stabilization mechanism for the blower unit 30 while providing in-suit cooling and hydration. When the head mounted configuration is desired, the same hydration bladder 300 and hydration back pack 330 unit that stabilized and supported the back mounted configuration can still be used independently for in-suit cooling and hydration. The hydration back pack 330 has a pouch that securely holds the hydration bladder 300 that contains water or other hydrating liquid and a hydration tube 310 for distributing the liquid to the worker's mouth when the worker uses the hydration mouth piece 320. The hydration bladder 300 is designed of material that can withstand freezing so that as a further cooling option the liquid can be frozen inside the hydration bladder 300 and worn to cool the body. When the frozen liquid thaws, the worker can consume the liquid hands free via the connected hydration tube 310 and hydration mouth piece 320 inside the suit.

In either the head or back mounted configuration, air 200 is brought in to the filter 10 through the filter intake ducts 80 and contaminants are removed by the filter 10. The high output blower 30 forces a jet stream of air 200 throughout the suit delivering cooling to the body and filtered air to breath. The blower 30 and filter 10 combination has been designed for easy modular use in either the head or back mounted configuration. Furthermore, the absence of air hoses, either to external or internal air sources, gives the worker a key advantage in comparison to the current air flow designs used by the industry. When the back mounted configuration is in place, the air 200 flows up into the hood 170 over the worker's head to the face and then down over the body. When the head mounted configuration is in place, the air 200 flows directly forward and down over the worker's face and then down over the body. The air 200 then exits through vents 180 placed in the suit in such locations as the worker's elbow, waist, and calf. Such full body air 200 flow provides cooling to the worker's entire body. As the worker is able to stay cooler than in suits currently used in the industry, the worker is able to be more productive and less likely to have his vision impaired by a fogged face visor or hood.

I claim:

1. A personal anti-contamination device comprising:

an anti-contamination suit having a hood portion worn by a worker;

a single, and only a single, circular intake hole disposed on said anti-contamination suit on the hood or back;

a single, and only a single, powered blower internal to said anti-contamination suit;

a stabilizing mechanism removably attached to said powered blower;

a single, and only a single, particulate filter external to said anti-contamination suit extending through said hole in said anti-contamination suit and removably connected to said powered blower;

a spider ring fixedly attached to said blower wherein said spider ring facilitates air flow from said blower and serves as a platform for mounting a plurality of attachable devices; and a single, and only a single, power source connected via an electrical wire to said powered blower.

2. The personal anti-contamination device of claim 1 further comprising a protective collar external to said anti-contamination suit, said protective collar sealing said suit when said powered blower and said particulate filter are connected.

3. The personal anti-contamination device of claim 1 wherein said stabilizing mechanism attaches to the head of the worker such that the powered blower provides direct locational cooling to the worker's face and a filtered air source to breath.

4. The personal anti-contamination device of claim 3 wherein said stabilizing mechanism further comprises a suspension system connected to said powered blower for absorbing motion of the blower and a swivel mechanism connected to the suspension system for allowing the head of the worker to rotate freely inside the hood without translating such movement to the stabilizing mechanism.

5. The personal anti-contamination device of claim 1 wherein said power source is a battery pack belt attaching to the waist of the worker, said battery pack having a multitude of locking connections for the connection of external devices.

6. The personal anti-contamination device of claim 1 wherein the stabilizing mechanism attaches to the back of the worker and further comprises a back strap harness which facilitates connection to the worker.

7. The personal anti-contamination device of claim 1 further comprising a hydration pack for containment of a fluid wherein said pack also functions as the stabilizing mechanism attached to the back of the worker with matching shoulder straps.

8. A personal anti-contamination device comprising:

an anti-contamination suit having a hood portion worn by a worker;

a single, and only a single, circular intake hole disposed on said anti-contamination suit on the hood or back;

a single, and only a single, powered blower internal to said anti-contamination suit having a cylindrically threaded portion extending through said hole in said anti-contamination suit;

a stabilizing mechanism removably attached to said powered blower;

a spider ring fixedly attached to said powered blower wherein said spider ring facilitates air flow from said blower and serves as a platform for mounting a plurality of attachable devices;

a single, and only a single, particulate filter external to said anti-contamination suit having a cylindrically threaded portion extending through said hole in said anti-contamination suit and meshing with the threaded portion of said powered blower;

a single, and only a single, protective collar external to said anti-contamination suit which surrounds the cylindrically threaded portion of said powered blower having a diameter larger than the cylindrically threaded portion of the powered blower, said protective collar sealing said suit when the threaded portions of said powered blower and said particulate filter are tightened; and a single, and only a single, power source for providing power to said powered blower connected via an electrical wire with locking connections.

9. The personal anti-contamination device of claim 8 wherein said stabilizing mechanism attaches to the head of the worker such that the powered blower provides direct locational cooling to the worker's face and a filtered air source to breath.

10. The personal anti-contamination device of claim 9 wherein said stabilizing mechanism further comprises:

a suspension system for absorbing motion of the powered blower thereby preventing or lessoning any impact on the head of the worker;

a halo band fixedly attached to said suspension system and encircling the top of the head of the worker;

an adjustable headband for securing said stabilizing mechanism to the head of the worker; and a swivel mechanism fixedly attached to said adjustable headband and slidingly connected to the halo band via a set of parallel rollers allowing the head of the worker to rotate freely inside the hood.

11. The personal anti-contamination device of claim 9 wherein said spider ring supports a camera directly attached to said spider ring, and only to said spider ring, for capturing images from the same viewpoint as the worker.

12. The personal anti-contamination device of claim 9 wherein said spider ring supports a dosimeter attached to said spider ring.

13. The personal anti-contamination device of claim 9 wherein said anti-contamination suit covers the worker's entire body.

14. The personal anti-contamination device of claim 13 wherein said blower provides cooling via a positive pressure and a large volume of filtered air to the worker's entire body with a plurality of exhaust vents providing exits for said air.

15. The personal anti-contamination device of claim 8 wherein said power source is a battery pack belt attaching to the waist of the worker, said battery pack having a multitude of locking connections for the connection of external devices.

16. The personal anti-contamination device of claim 8 wherein said suit is made of any flexible material and said hood portion of said suit is made of any transparent material.

17. The personal anti-contamination device of claim 8 wherein the stabilizing mechanism attaches to the back of the worker.

18. The personal anti-contamination device of claim 17 wherein the stabilizing mechanism further comprises a back strap harness which facilitates connection to the worker.

19. The personal anti-contamination device of claim 17 wherein a multitude of exhaust vents are disposed on said anti-contamination suit.

20. The personal anti-contamination device of claim 17 wherein the stabilizing mechanism further comprises a hydration pack for containment of a fluid, said hydration pack comprising a liquid containment vessel and a hydration tube extending to face of the worker for consumption of said fluid.

21. The personal anti-contamination device of claim 8 further comprising a hydration pack for containment of a fluid, said hydration pack comprising a back strap harness for attaching the pack to the back of the worker and serving as a stabilization mechanism, a liquid containment vessel, and a hydration tube extending to face of the worker for consumption of said fluid.

22. A personal anti-contamination device comprising:

an anti-contamination suit made of any flexible material having a hood portion made of any transparent material worn by a worker;

a single, and only a single, circular intake hole disposed on said anti-contamination suit on the hood or back;

a single, and only a single, powered blower internal to said anti-contamination suit having a cylindrically threaded portion extending through said hole in said anti-contamination suit for providing high volume direct locational cooling to the worker's face and body and a filtered air source to breath;

a stabilizing mechanism removably attached to said powered blower;

a spider ring fixedly attached to said powered blower wherein said spider ring facilitates air flow from said blower and serves as a platform for mounting both a camera and a dosimeter;

a single, and only a single, particulate filter external to said anti-contamination suit having a cylindrically threaded portion extending through said hole in said anti-contamination suit and meshing with the threaded portion of said powered blower;

a protective collar external to said anti-contamination suit which surrounds the cylindrically threaded portion of said powered blower having a diameter larger than the cylindrically threaded portion of the powered blower, said protective collar sealing said suit when the threaded portions of said powered blower and said particulate filter are tightened;

a single, and only a single, battery pack belt attached to the waist of the worker, said battery pack having a multitude of locking connections for providing power to said blower and a multitude additional devices; and a multitude of exhaust vents disposed on said anti-contamination suit.

23. The personal anti-contamination device of claim 22 wherein said stabilizing mechanism attaches to the head of the worker and further comprises:

a suspension system for absorbing motion of the powered blower thereby lessoning any impact on the head of the worker;

a halo band fixedly attached to said suspension system and encircling the top of the head of the worker;

an adjustable headband for securing said stabilizing mechanism to the head of the worker; and a swivel mechanism fixedly attached to said adjustable headband and slidingly connected to the halo band via a set of parallel rollers allowing the head of the worker to rotate freely inside the hood.

24. The personal anti-contamination device of claim 22 wherein the stabilizing mechanism attaches to the back of the worker and further comprises a back strap harness which facilitates connection to the worker.

* * * * *